US005639937A

United States Patent [19]

Höver et al.

[11] Patent Number: 5,639,937

[45] Date of Patent: Jun. 17, 1997

[54] PROCESS FOR THE PRODUCTION OF OLEFINS

[75] Inventors: Hermann Höver, Bornheim; Hartmut Hammer, Köln, both of Germany

[73] Assignee: RWE, Entsorgung Aktiengesellschaft, Germany

[21] Appl. No.: 142,298

[22] PCT Filed: Mar. 12, 1993

[86] PCT No.: PCT/DE93/00226

§ 371 Date: Jan. 12, 1994

§ 102(e) Date: Jan. 12, 1994

[87] PCT Pub. No.: WO93/18112

PCT Pub. Date: Sep. 16, 1993

[30] Foreign Application Priority Data

Mar. 13, 1992 [DE] Germany ..... 42 07 976.4

[51] Int. Cl.[6] ..... C07C 1/00; C07C 4/04

[52] U.S. Cl. ..... 585/241; 208/72

[58] Field of Search ..... 585/241, 648; 208/22, 72

[56] References Cited

U.S. PATENT DOCUMENTS

| | | | |
|---|---|---|---|
| 3,956,414 | 5/1976 | Oshima | 585/241 |
| 3,985,820 | 10/1976 | Albright et al. | 585/241 |
| 4,851,601 | 7/1989 | Fukuda et al. | 585/241 |
| 4,982,027 | 1/1991 | Korff et al. | 585/24 |
| 5,232,489 | 8/1993 | Mertens-Gottselig et al. | 75/715 |
| 5,364,995 | 11/1994 | Kirkwood et al. | 585/241 |

FOREIGN PATENT DOCUMENTS

| | | |
|---|---|---|
| 34 42 506 | of 0000 | Germany . |
| 4 028 999 | of 0000 | Germany . |
| 63-132995 | 4/1988 | Japan . |

OTHER PUBLICATIONS

Fuji Recycle Industry KK, *Japan Chemical Week*, "Useful Oil Reclaimed from Waste Plastics (Polyolefin)", May 31, 1990, pp. 6 and 7.

*Primary Examiner*—Glenn A. Caldarola
*Assistant Examiner*—Bekir L. Yildirim
*Attorney, Agent, or Firm*—Connolly & Hutz

[57] ABSTRACT

The instant invention relates to a process for the production of olefins from plastic waste, which comprises adjustment of a desired viscosity by thermal pretreatment of plastic waste in a temperature range of 350° to 550° C. and thermal treatment of the product obtained by the thermal pretreatment in a temperature range of 700° to 1100° C.

17 Claims, 1 Drawing Sheet

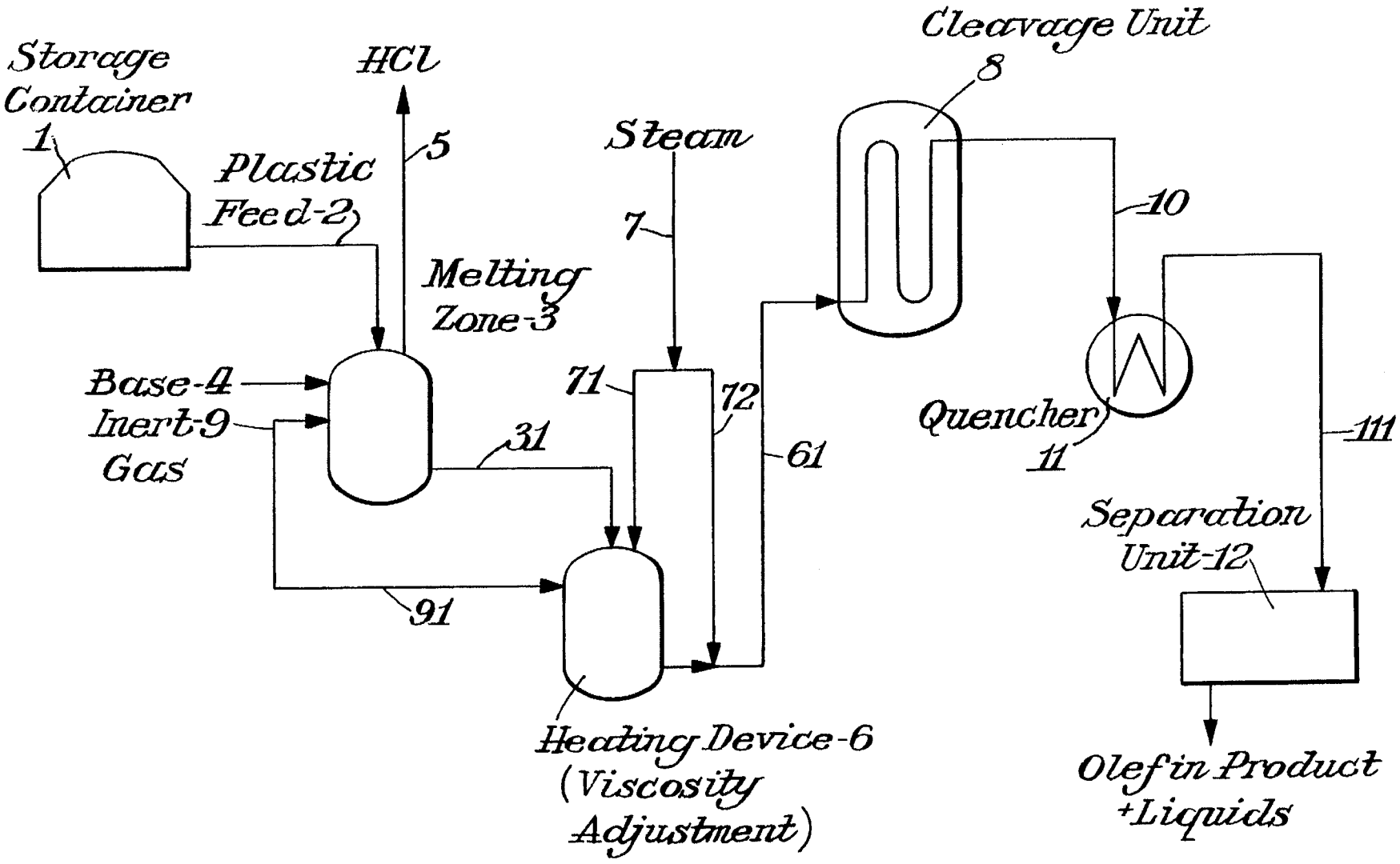
Storage Container 1
Plastic Feed-2
HCl
5
Melting Zone-3
Base-4
Inert-9 Gas
31
91
Steam
7
71
72
61
Heating Device-6 (Viscosity Adjustment)
Cleavage Unit 8
10
Quencher 11
111
Separation Unit-12
Olefin Product +Liquids

PROCESS FOR THE PRODUCTION OF OLEFINS

FIELD OF THE INVENTION

The instant invention relates to a process for the production of olefins from plastic waste.

DESCRIPTION OF THE PRIOR ART

Waste management of plastic waste, in particular of contaminated mixtures of plastic waste, which leads to the production of valuable materials is to a considerable extent still a technically unsolved problem.

The separate collection of plastic packaging material in households and trade (dual system), which has been recently introduced in the Federal Republic of Germany at several locations is expected to lead after introduction of the system in the total area of Germany to a quantity of packaging waste of approximately 1 million tons per year.

Since waste incineration, labeled as "thermal recycling" encounters strong opposition in the public and since pyrolysis, i.e. heating of plastic waste in the absence of oxygen, leads essentially to products of little value, at present only few processes are promising with regard to the production of useful, valuable materials from plastic waste, which can be used as substitutes for products made from crude oil.

In addition, these processes are in an experimental state at present. One of these more promising processes is the hydrogenative cleavage of mixtures of plastic waste at high hydrogen pressure and at high temperature, whereby depending on the feed material, up to 90 weight-% of saturated hydrocarbons may be obtained, boiling in the range of gasoline and gas oil.

This process has been disclosed in several patents, for example, in the German Patent P 34 42 506 and in the European Patent 0 236 701.

A further interesting process, which permits the separation of composite materials into the individual components, in particular composite paper/polyethylene/aluminum-foils, which serve as packaging material for beverages, has been disclosed in German Patent P 40 28 999.

By these processes, after having been developed into an industrial stage, at least part of the waste, consisting of plastic packaging material can be reused in a reasonable way.

A process, by which in a thermal and a catalytical stage, polyethylene, polypropylene and polystyrene, respectively mixtures of these components can be cleaved, forming unsaturated and saturated hydrocarbons, is described in Japan Chemical Week May 31, 1990, pages 6 and 7.

In a temperature range of up to 500° C., approximately 60 weight-% of liquid hydrocarbons, 30 weight-% of gaseous hydrocarbons and 10 weight-% of a coke-like residue are obtained.

Approximately 50 weight-% of the liquid products are unsaturated hydrocarbons. Ethylene and propylene are obtained only in a quantity of 4.5 and 7.6 weight-% respectively.

SUMMARY OF THE INVENTION

By the instant invention applicant has now succeeded in further improving recycling of plastic waste, by a process, characterized in that plastic waste is transferred into a molten state by heating, the viscosity of the melt is adjusted to a desired value by thermal cracking, and the product thus obtained is heated to 700° to 1100° C., at a residence time of 0,02 to 10 seconds.

BRIEF DESCRIPTION OF THE DRAWINGS

The sole FIGURE of the Drawing is a simplified schematic or flow sheet illustrating an apparatus suitable for carrying out the process of this invention.

DETAILED DESCRIPTION

Although the thermal cleavage of so-called naphtha, which represents a crude oil fraction boiling in a range of approximately 100° to 170° C., is the most important process at present for the production of ethylene and propylene, and although it is known that gas oil and vacuum gas oil can also be cleaved to ethlene and propylene in satifactory yields, and although it is known that even crude oil can be thermally cleaved, whereby also ethylene and propylene are obtained to a certain extent, the person skilled in the art, has until now not been able to solve the problem of producing ethylene and propylene by direct thermal treatment of plastic waste after a thermal pretreatment, although such a process represents genuine recycling of plastic materials.

For the first time applicant has succeeded in demonstrating that by the inventive thermal pretreatment of plastic waste with adjustment of a desired viscosity in a temperature range of 350° to 550° C., preferably of 400° to 500° C. and by thermal treatment of the material thus obtained, in a temperature range of 700° to 1100° C., ethylene can be produced in an average yield of approximately 30 weight-%, which can be even higher. In addition $C_3$-$C_4$-olefins can be produced.

The temperature range for the pretreatment covers the melting range of the plastic waste up to cracking conditions, known from thermal cracking of crude oil residues, beginning with so-called visbreaking as a mild version of cracking.

The temperature to be applied in the pretreatment stage, which serves to adjust the viscosity of the molten feed, is preferably selected in such a way that the liquid thus obtained, can be evaporated and that the liquid can be conveyed by pumps, by extruders or other conveying devices into the second treatment stage, where evaporation and thermal cleavage to olefins takes place. The residence time in the first stage may be 2 to 1500 minutes. Alternatively evaporation may be carried out already in the pretreatment stage. It may be sufficient to apply mild cracking condition, or cracking at only low severity. However the severity of cracking can be adjusted to the feed material and to the necessary conditions to evaporate such feed material.

An important aspect with regard to choosing temperature and residence time in the pretreatment stage is the optimization of the ethylene and propylene yields in the thermal treatment stage at 700° to 1100° C. This means that the process conditions in the pretreatment stage are selected in such a way that in the treatment stage at 700° to 1100° C., optimized olefin yields are obtained.

It is of advantage to introduce steam already in the pretreatment stage. Steam may serve to facilitate evaporization of the liquified material of adjusted viscosity. It has been found that it may be of advantage, if the thermal pretreatment, which serves to adjust the viscosity of the liquified feed material, is preceeded by a thermal treatment, which causes melting of the plastic waste, whereby a temperature is chosen of 200° to 480° C., preferably of 250° to 430° C. The residence time may be again 2 to 1500 minutes.

Furthermore the preceeding thermal treatment is carried out in such a way that chlorine, present in the feed material, is predominantly or completely eliminated as HCl.

Elimination of chlorine by HCl-formation takes place of course, also in the actual pretreatment stage. In this stage chlorine can also be removed completely or almost completely.

Elimination of HCl may be facilitated by introducing a stream of inert gas, which may be among others $N_2$, $H_2$, $CO_2$ or steam. Furthermore, eliminating HCl may be improved and completed by addition of basic materials like alkali and alkaline earth derivatives.

In the preceeding thermal stage as well as in the pretreatment stage for adjusting the viscosity elevated temperatures are usually accompagnied by short residence times and vice versa.

The stage for adjusting the viscosity as well as the preceeding stage are preferably operated under inert gas, for example $N_2$, $CO_2$, $H_2$, steam and others. Also application of vacuum or working under pressure are possible.

Temperature range and residence time, which are applied in the thermal treatment at 700° to 1100° C., essentially correspond to the conditions applied in the production of ethylene from feed materials, outlined above.

Preferably this treatment is carried out in the presence of added steam. However instead of steam also hydrogen can be added or a mixture of hydrogen and steam can be applied.

The feed ratio of plastic waste and steam respectively hydrogen usually is 1 part by weight of plastic waste to 0.1–2 parts by weight of steam. A ratio of 1 part by weight to 0.3–1.3 parts by weight is preferred. The temperature is 700° to 1100° C., preferably 750° to 900° C. and particularly preferably 780° to 860° C.

The residence time is 0.02 to 10 seconds, preferably 0.1 to 2 seconds. According to the instant invention it is preferred to adjust the viscosity in such a way that the feed material for the thermal treatment stage, which is operated at 700° to 1100° C., is evaporated and that the vapor is cleaved into olefins.

In principle the feed material of adjusted viscosity can also be introduced into the thermal treatment stage, which is operated at 700° to 1100° C., in the liquid state.

Feed material, which is particularly well suited for the inventive process, is plastic waste of the group: polyethylene, polypropylene, polystyrene, polyisobutene, polybutene, polyvinylchlord or also linear polybutadiene and similar materials, or any mixture of these components.

If halogen containing material, in particular polyvinylchloride is present in the feed for the pretreatment stage, or the stage which may preceed the thermal pretreatment stage, chlorine is completely, or almost completely removed as HCl or at least predominantly as HCl, whereby basic materials may be added in order to facilitate the HCl-elimination.

Work up of the products of the stage operated at 700° to 1100° C. can be carried out in analogy to work up of the products in the conventional production of ethylene.

Cleavage of the feed material can take place in directly fired steel coils, mixed with steam in a ratio of 0.1 to 2 parts by weight of steam to 1 part by weight of feed material at a residence time of 0.02 to 10 seconds, or 0.1 to 2 seconds. Instead of steam, hydrogen or a mixture of steam and hydrogen may be used as outlined above.

In principle cleavage of the products of the thermal treatment stage for adjusting the viscosity or of the combination of this stage with a preceeding thermal stage or only of the preceeding stage, may also be carried out autothermally in a fluidized bed, whereby a material, which forms the fluidized bed, like coke, sand and others, is in contact with the feed material to be cleaved, which is preferably in a liquid state and whereby part of the feed material may be burned to $CO_2$ and water, in order to maintain the necessary cleavage temperature. Furthermore the feed materials described above may be cleaved into olefins in analogy to the Advanced Cracking Reactor Process of Union Carbide or to the Dow-process or other crude oil cleavage processes.

However the essential characteristic of the instant invention is not the cleavage process known from ethylene production, but the combination of the transformation of plastic waste into a product of desired viscosity and the application of the cleavage temperature of 700° to 1100° C. in order to thermally cleave the product of the pretreatment stage into olefins at a residence time of 0.02 to 10 seconds.

Turning now to the Drawing, the figure represents the process of this invention in an exemplary and simplified manner.

Plastic waste, for example from garbage, is stored in storage container 1. The plastic waste is conveyed from container 1 through feed line 2 into the first thermal stage or melting zone 3, which is provided with lines 4 and 9, through which base and inert gas, respectively, can be conveyed. HCl is removed through line 5. The liquid product of the melting zone 3, which product is essentially free of halogen, is fed into a second thermal stage or heating device 6 in order to adjust the viscosity. Device 6 is fed with inert gas from branch 91 of line 9 and with steam from branch 71 of steam line 7. (A second branch 72 of steam line 7 introduces steam into line 61.) Optionally, base can also be introduced into device 6 (line not shown). From device 6 the viscosity-adjusted material is fed via line 61 to cleavage unit 8, which is operated at 700° to 1100° C. The cleaved product flows through line 10 to quencher 11 and from quencher 11 through line 111 to separation unit 12, which separates the final product mixture into olefins and products which are liquid under normal conditions. The separation technology for separating the olefins into individual components is known to persons skilled in the art and therefore will not be outlined in detail.

What is claimed is:

1. A process for the production of at least one olefin from a plastics mixture consisting essentially of plastic waste collected from household or trade sources, said plastics mixture including polyvinylchloride and at least one of the following: polyethylene, polypropylene, polystyrene, polyisobutene, polybutene, or linear polybutadiene, said process comprising:

heating the plastics mixture in a first thermal stage to obtain a melt, to a temperature of 200° to 480° C. for a residence time of sufficient length to essentially eliminate the chlorine of said polyvinylchloride; adjusting the viscosity of the melt in a second thermal stage, wherein the melt is essentially free of chlorine, by thermally cracking, thereby obtaining a viscosity-adjusted liquid intermediate product, which is volatilized and the vapor obtained from the volatilized liquid intermediate product is fed into an olefin-producing reactor for the production of olefins;

operating said olefin-producing reactor at a temperature in the range of 700° to 1100° C. and adding steam to the vapor in a ratio of 0.1 to 2 parts by weight of steam to one part by weight of vapor and whereby the residence time of the vapor in said olefin-producing reactor is 0.02 to 10 seconds, and recovering the ethylene or a $C_3$- or $C_4$-olefin or a mixture thereof.

2. Process according to claim 1, wherein said residence time in said first thermal stage ranges from 2 to 1500 minutes.

3. Process according to claim 1, wherein the chlorine of said polyvinylchloride is eliminated in said first thermal stage as hydrogen chloride.

4. Process according to claim 1, wherein the adjusting of the viscosity is carried out at a temperature in the range of 380° to 500° C.

5. Process according to claim 1, wherein the adjusting of the viscosity is carried out for a period of time from 2 to 1500 minutes.

6. Process according to claim 1, wherein said plastics mixture contains polystyrene.

7. Process according to claim 6, wherein a base is added during said heating of the plastics mixture.

8. Process as claimed in claim 1, wherein said olefin-producing reactor is operated at a temperature in the range of 750° to 900° C.

9. Process as claimed in claim 1, wherein said olefin-producing reactor is maintained at a temperature in the range of 700° to 1100° C. for 0.1 to 2 seconds.

10. Process according to claim 1, wherein said intermediate product is volatilized in the presence of steam.

11. Process according to claim 1, wherein said vapor is heated in said olefin-producing reactor with steam in a ratio of 0.1 to 2 parts by weight of steam to each part by weight of said vapor.

12. Process according to claim 11, wherein said ratio is 0.3 to 1.3 parts by weight of steam to each part by weight of said vapor.

13. Process according to claim 1, wherein said plastic waste of said plastics mixture contains, in addition to the polyvinyl chloride, at least the following plastic materials: polyethylene, polypropylene, and polystyrene.

14. Process according to claim 13, wherein said plastic waste is a contaminated mixture.

15. Process according to claim 1, wherein the adjusting of the viscosity is carried out under inert gas.

16. Process according to claim 1, wherein the heating of the plastic waste in said first thermal stage is carried out under inert gas.

17. Process according to claim 1, wherein:

the heating of the plastic waste in said first thermal stage is carried out for 2 to 1500 minutes, the adjusting of the viscosity of the melt is carried out at 400° to 480° C., thereby obtaining said intermediate product.

* * * * *